343-909 SR
4/12/77 XR 4,017,865

United States Patent [19]
Woodward

[11] 4,017,865
[45] Apr. 12, 1977

[54] FREQUENCY SELECTIVE REFLECTOR SYSTEM

[75] Inventor: Oakley McDonald Woodward, Princeton, N.J.

[73] Assignee: RCA Corporation, New York, N.Y.

[22] Filed: Nov. 10, 1975

[21] Appl. No.: 630,696

[52] U.S. Cl. ..... 343/781 CA; 343/909
[51] Int. Cl.[2] ..... H01Q 19/14
[58] Field of Search ..... 343/781, 909, 781 CA, 343/840

[56] References Cited

UNITED STATES PATENTS

| | | | |
|---|---|---|---|
| 3,148,370 | 9/1964 | Bowman | 343/909 |
| 3,231,892 | 1/1966 | Matson et al. | 343/909 |
| 3,394,378 | 7/1968 | Williams et al. | 343/909 |
| 3,633,206 | 1/1972 | McMillan | 343/781 |

*Primary Examiner*—Eli Lieberman
*Attorney, Agent, or Firm*—Edward J. Norton; Robert L. Troike; L. Weiss

[57] ABSTRACT

A dual- band Cassegrain antenna system operable at any polarization is described wherein the hyperbolic subreflector is made to reflect signals at a first band of frequencies and to transmit or pass signals at a second lower band of frequencies. The hyperbolic subreflector according to one embodiment is a square grid mesh with conductive rings centered along the connecting legs of the square grid mesh. The rings are approximately one-third wavelength in diameter at the first band of frequencies and act capacitively at the second lower band of frequencies. The inductive reactance provided by the conductive connecting legs of the grid mesh together with the capacitive reactance provided by the rings at the lower band of frequencies causes the subreflector to transmit signals at the second lower band of frequencies.

9 Claims, 6 Drawing Figures

FREQUENCY SELECTIVE REFLECTOR SYSTEM

BACKGROUND OF THE INVENTION

This invention relates to antennas and particularly to a dual-band antenna system using a dichroic reflecting surface.

The term "dichroic reflecting surface" as used herein refers to a configuration of conducting elements designed to transmit some frequencies while stopping or reflecting others. These dichroic reflecting surfaces can be made by geometric configurations of conducting elements printed or attached to a dielectric supporting layer. Although this arrangement is adequate for moderate power level signals, dielectric breakdown can occur for very high powers at the high potential points of the conducting elements. It is therefore very desirable to arrive at a design for very high power applications which is capable of being entirely self-supporting without the need of any dielectric. It is further desirable that the dichroic reflecting surface operate at any polarization of the transmit or reflecting signal.

BRIEF DESCRIPTION OF INVENTION

Briefly, a surface transmitting some selected frequencies while reflecting other frequencies is provided by a grid mesh of conducting elements including rows and columns of rings. The rings are of conductive material and are of a diameter approximately one-third of a wavelength at the desired reflecting frequencies. An inductive reactance provided by the mesh assembly in combination with the capacitive reactance of the rings at a frequency below the reflecting frequency provides low attenuating transmission at the lower frequency of the surface.

IN THE DRAWINGS

A more detailed description follows in conjunction with the following drawings, wherein.

DETAILED DESCRIPTION OF THE INVENTION

Figure 1:
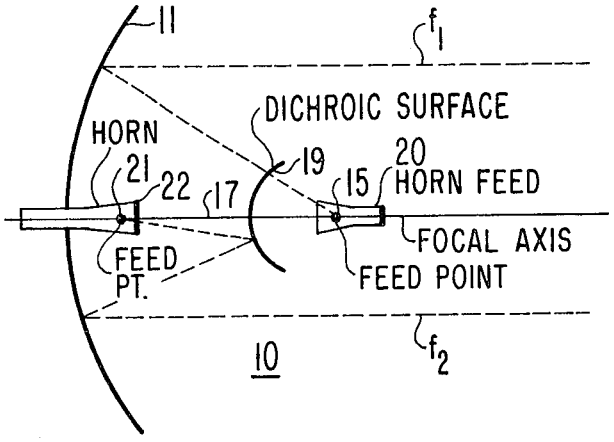
FIG. 1 is a sketch of a Cassegrain antenna system.

Referring to FIG. 1, a Cassegrain antenna system 10 comprises a parabolic reflector 11 and a resultant focal or feed point 15 located on focal axis 17. Positioned along the focal axis 17 between parabolic reflector 11 and feed point 15 is located a hyperbolic reflector 19. The hyperbolic reflector 19 has a feed point 21 located along the focal axis 17 between the parabolic reflector 11 and the hyperbolic reflector 19. An antenna feed horn 20 which is dimensioned to couple signals at a frequency $f_1$ is located at the feed point 15 of the parabolic reflector 11. A second feed horn 22 which is dimensioned to couple signals at a higher frequency $f_2$ is positioned at the feed point 21 of the hyperbolic reflector 19. A dual frequency antenna system is provided by making the hyperbolic subreflector 19 transparent at frequency $f_1$ and reflective at frequency $f_2$. Signals at frequency $f_1$ are therefore coupled through the hyperbolic reflector 19 in the path between the parabolic reflector 11 and the feed point 15. The hyperbolic reflector 19 provides no blockage of signals in this path. Signals at frequency $f_2$ are reflected by the parabolic reflector 11 and the hyperbolic reflector 19 in either transmit or receive modes. There is little cross-coupling between the signals at $f_1$ and $f_2$ because of the reflection of the signals at $f_2$ by the hyperbolic reflector 19 and the transmission of the signals at $f_1$.

Figure 2:
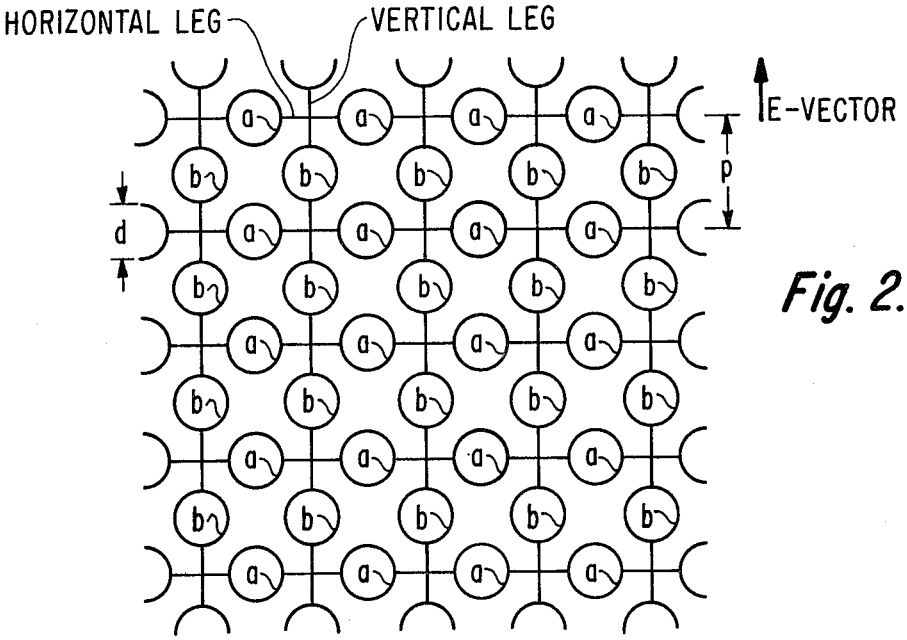
FIG. 2 is a sketch of a section of a dichroic surface according to a first embodiment of the present invention.

As stated previously, it is desirable that the dichroic surface of hyperbolic reflector 19 be self-supporting. In this manner, no dielectric supporting layer would be required and dielectric breakdown would not occur at the high potential points of the conducting elements. Referring to FIG. 2, there is illustrated a self-supporting dichroic surface. The surface is comprised of a square grid mesh of conducting elements with the legs of the mesh comprising metal rings in series with connecting linear conductors. In FIG. 2, rings marked *a* are arranged in a row with the rings *a* connected to each other by horizontal conductors of the square grid mesh. Rings marked *b* are arranged in columns with rings *b* connected to each other by the vertical conductors of the square grid mesh. The rings *a* or *b* are centered along the connecting legs of the square grid mesh. The metal rings *a* and *b* are approximately one-third of a wavelength in diameter (diameter *d* in FIG. 2) at the reflecting frequency of $f_2$. The centers of the rings are spaced approximately one-half wavelength apart (distance *p* in FIG. 2) at the reflecting frequency $f_2$ to prevent undesired grating lobes at high incident angles of the wavefront. These high incident angles occur because of the curved surface of the hyperbolic reflector.

The electrical characteristic of the rings may be represented by an inductance in series with the capacitance across a transmission line representing free space. Series resonance of the ring occurs at the reflecting frequency $f_2$. This circuit formed by the ring array is inductive at higher frequencies and capacitive at lower frequencies. At very low frequencies the capacitive reactance of the ring array becomes very high and the surface is therefore very nearly transparent to an incoming wavefront. In actual practice, however, it is often required that the ratio between the reflecting frequency of $f_2$ and transmitting frequency $f_1$ be moderately small. The square grid mesh of conducting elements as described above in connection with FIG. 2 functions to provide an inductive reactance at frequencies below the reflecting frequency $f_2$ of the ring array. The length of the legs of the square grid are made such that at the frequency $f_1$, the inductive reactance presented by the connecting leg elements to signals at $f_1$ becomes equal to the capacitive reactance presented by the rings to signals at $f_1$ giving parallel resonance and hence perfect transmission at frequency $f_1$.

Figure 3:
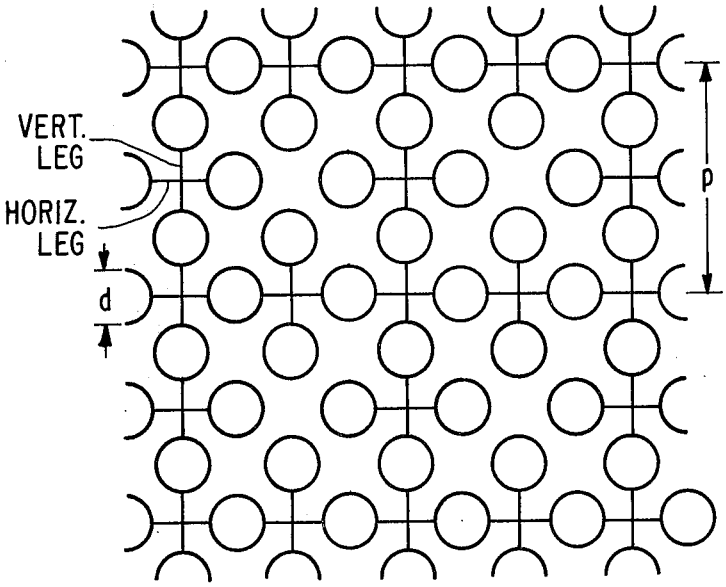
FIG. 3 is a sketch of a section of a dichroic surface according to a second embodiment of the present invention.

For an incoming linearly-polarized wave with the E-vector as illustrated in FIG. 2, only the rings marked *a* will be series resonant at the reflect frequency of $f_2$. Since the midpoints of these rings are at zero potential, the horizontal legs attached at their midpoints carry no current. For this polarization, the rings marked *b* function merely as added series inductances in the legs of the square grid mesh. From the geometric symmetry of the design, it is apparent that an incoming wave with orthogonal horizontal polarization will produce series resonance at the *b* rings and not in the *a* rings. The surface will then reflect a wave of horizontal polarization. Hence the reflector can reflect signals at one frequency $f_2$ and transmit (pass) signals at a second frequency $f_1$ regardless of the polarization (including circular or elliptical). Referring to FIG. 3, a larger frequency band ratio may be obtained by removing portions of some of the cross-interconnecting bars or legs of the square grid mesh. This change does not effect the reflect frequency $f_2$ but permits lowering of the transmit frequency due to the increased mesh size (legs are longer with a series of rings along each leg) and to the added capacitance loading across the mesh between ring elements in the region where the cross legs are removed.

Experimental tests were carried out in an anechoic chamber where a testing horn and a receiving horn were directed at each other. At each test frequency two measurements were made. The received signal level was recorded with the panel removed and with the panel placed in the signal path. The difference between these values is the transmission through the panel. The panel was 14 inches square with the elements having the same size as that plotted in FIG. 2. The rings *a* and *b* were approximately ⅜ of an inch in diameter with each leg about 23/32 inches long between the center of the rings. The rings were spaced approximately ⅜ inch apart.

Figure 4:
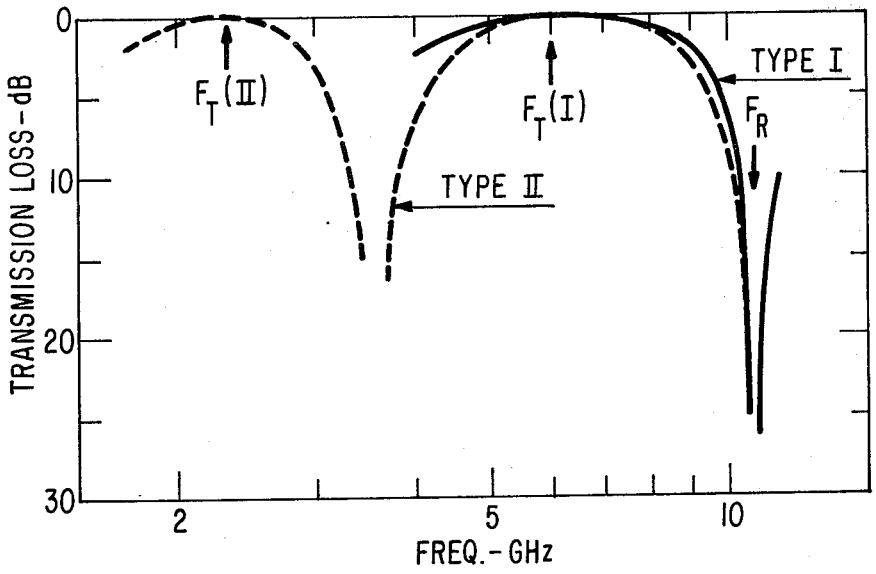
FIG. 4 is a plot of frequency vs. transmission loss for the dichroic surface illustrated in FIGS. 2 and 3.

FIG. 4 illustrates a measured transmission as a function of frequency. It is seen that both types (FIGS. 2 and 3) reflect at a midband frequency at $F_R$ (reflection frequency) of 10.85 gigahertz (GHz). The center transmit frequency is 6 GHz for the type I arrangement in FIG. 2 and is 2.3 GHz for the type II arrangement in FIG. 3. The frequency band ratios are 1.8 for the arrangement in FIG. 2 and 4.7 for the arrangement in FIG. 3. Some variation in either case can be made by small changes in the length of the legs of the mesh or the diameter of the rings.

Figure 5:
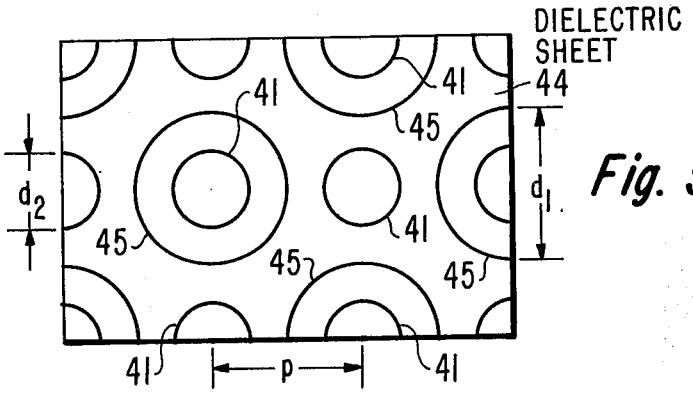
FIG. 5 is a section of a dichroic surface according to a third embodiment of the present invention.

Referring to FIG. 5, there is illustrated a double ring dichroic surface in which a dielectric support is used. In this arrangement small conductive rings 41 approximately one-third wavelength in diameter ($d_2$ in FIG. 5) at the reflection frequency $f_2$ are printed on a dielectric sheet 44. The spacing between the centers of the rings (p) is approximately one-half wavelength at this reflecting frequency $f_2$. Alternate small rings 41 are circled with larger conductive rings 45 which are series resonant at some lower frequency $f_l$. In the frequency range between $f_l$ and $f_2$ the array of small rings 41 present a capacitive reactance across the equivalent transmission line representing free space and the large array of rings 45 presents an inductive reactance across the line at same frequency in this range. At some frequency between $f_l$ and $f_2$ these two reactances are equal in magnitude providing parallel resonance and, hence, perfect transmission. For the arrangement of FIG. 1, ring diameters are selected such that the frequency at which the two reactances are equal in magnitude is selected to be frequency $f_1$.

Experimental tests were carried out in an anechoic chamber where a transmitting horn and a receiving horn were directed at each other. At each test frequency, the received signal was recorded with the panel removed and with the panel in the signal path between the horns. The difference between these values is the transmission loss of the panel. The panel was 14 inches square with the elements having the same size as that shown in FIG. 5. The smaller ring was slightly less than ⅜ of an inch in diameter. The larger ring was approximately ¾ of an inch in diameter. The space between the centers of the rings (*p*) was about 11/16 of an inch.

Figure 6:
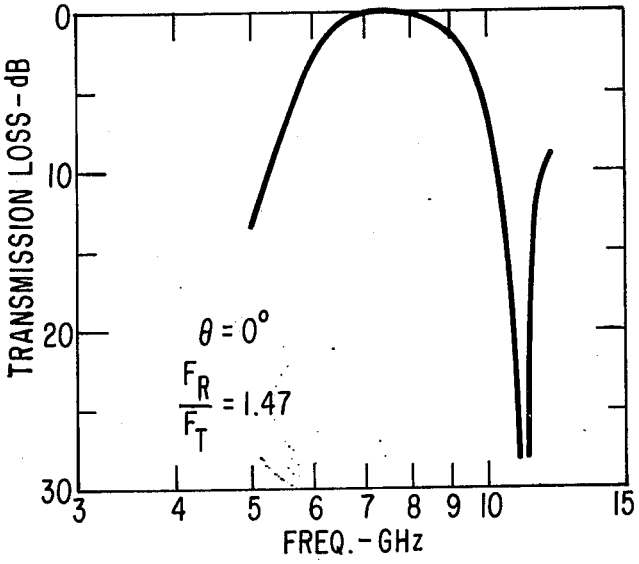
FIG. 6 is a plot of frequency vs. transmission loss for the arrangement illustrated in FIG. 5.

FIG. 6 is a plot of measured transmission as a function of frequency. As can be seen viewing FIG. 6, almost complete reflection is obtained at a frequency of 11.05 GHz and the surface is almost completely transparent at a frequency of 7.5 GHz. The ratio of the reflect to the transmit band is 1.47. Some variations in this value may be had by changing the diameters of either one or both of the rings. The advantages of this approach are simplicity in ring design and enhanced power handling capabilities because of the absence of sharp corners in the elements. A disadvantage, however, is the fact that in this arrangement the rings are not self-supporting as in the arrangements illustrated in FIGS. 2 and 3. Due to the ring symmetry, the surface will reflect a wave in the arrangement of FIG. 5 in any polarization including circular or elliptical. In the double ring dichroic surface as described in connection with FIG. 5, the diameter of the inner ring 41 would be selected to be approximately one third of a wavelength at the reflecting frequency ($f_2$) and the diameter of the larger ring 45 would be approximately one third of a wavelength at a frequency sufficiently lower than the transmitting frequency ($f_1$) to cause signal at the transmitting frequency ($f_1$) to pass through the reflector with low attenuation.

What is claimed is:

1. A self-supporting reflector adapted to pass signals at frequency $f_1$ and reflect signals at a higher frequency $f_2$ comprising:

a plurality of conductive square grids having equal length connecting legs of conductive material, at least some of said legs including a conductive ring of a diameter approximately one-third wavelength long at the frequency $f_2$ to reflect signals at frequency $f_2$, said legs being of a selected length and construction such that the inductive reactance presented by said legs at frequency $f_1$ equals the capacitive reactance of said rings at frequency $f_1$ giving parallel resonance and said reflector passes signals at frequency $f_1$ with low attenuation.

2. The combination claimed in claim 1 wherein each of said legs includes said ring centered along the length thereof.

3. The combination claimed in claim 1 wherein each of said legs includes a plurality of rings.

4. A reflector adapted to pass signals at frequency $f_1$ and reflect signals at a higher frequency $f_2$ comprising:

a first plurality of conductive rings arranged in rows and columns, said rings being of a diameter approximately one-third wavelength long at said frequency $f_2$, a second plurality of rings surrounding alternate rings of said first plurality of rings with said second rings of a diameter approximately one-third wavelength at a frequency sufficiently lower than $f_1$ that the inductive reactance presented by each of said second plurality of rings equals the capacitive reactance presented by an associated ring of said first plurality of rings at the frequency $f_2$ to cause said signals at $f_1$ to pass said reflector with low attenuation.

5. A dual frequency band antenna system with low grating lobes comprising:

a first reflector having a focal axis and a first focus point, a first feed means located at said focus point adapted to couple signals at a first frequency $f_1$, a second curved surface reflector having a focal axis substantially coincident with the focal axis of said first reflector and being positioned along the focal axis of said first reflector between said first reflector and the focus point of said first reflector, said second reflector having a focus point substantially along said focal axis of said first reflector at a point between said first and second reflectors, a second feed means located at the focus point of said second reflector adapted to couple signals at a frequency $f_2$ higher than said first frequency $f_1$, said second reflector including conductive rings one-third wavelength in diameter at frequency $f_2$ with the ring centers spaced one-half wavelength apart at frequency $f_2$ for providing reflection of signals at a frequency $f_2$ and a plurality of conductive members of a selected length positioned with respect to said rings for presenting an inductive reactance at said frequency $f_1$ equal to the capacitive reactance presented by said rings at frequency $f_1$ causing said reflector to pass signals at frequency $f_1$.

6. The combination claimed in claim 5 wherein said antenna system is a Cassegrain antenna system where said first reflector is the main parabolic reflector and said second reflector is a hyperbolic subreflector.

7. The combination claimed in claim 5 wherein alternate rings of said plurality of rings are surrounded by a second ring of a diameter approximately one-third of a wavelength in diameter at a frequency lower than $f_1$.

8. The combination claimed in claim 5 wherein said second reflector includes a square grid of conductors with the legs including a conductive ring of one-third wavelength diameter at frequency $f_2$.

9. A frequency selective reflector comprising:

a plurality of conductive rings approximately one-third wavelength in diameter at a desired frequency $f_2$ and a plurality of conductive members of a selected length and configuration positioned with respect to said rings for presenting in the region of said rings an inductive reactance at a desired pass frequency $f_1$ equal to the capacitive reactance presented by said rings at frequency $f_1$ to cause said reflector to pass signals at frequency $f_1$ with low attenuation.

* * * * *